US006085918A

United States Patent [19]

Duff et al.

[11] Patent Number: 6,085,918

[45] Date of Patent: Jul. 11, 2000

[54] SHELVING SYSTEM BRACE AND POST

[75] Inventors: James A. Duff; Mark L. Nunn, both of Omaha, Nebr.

[73] Assignee: Lozier Corporation, Omaha, Nebr.

[21] Appl. No.: 09/280,596

[22] Filed: Mar. 29, 1999

[51] Int. Cl.[7] ..... A47B 9/00

[52] U.S. Cl. ..... 211/191; 108/109

[58] Field of Search ..... 312/263, 257.1, 312/265; 211/189, 190, 186, 191, 192, 187, 208; 108/102, 188, 108, 109; 52/739.1

[56] References Cited

U.S. PATENT DOCUMENTS

| | | | |
|---|---|---|---|
| 5,692,341 | 12/1997 | Erlandson | 312/245 |
| 5,735,221 | 4/1998 | Benayon . | |
| 5,791,498 | 8/1998 | Mills | 211/183 |

FOREIGN PATENT DOCUMENTS

| | | | |
|---|---|---|---|
| 3936485 | 5/1991 | Germany | 211/191 |
| 406127641 | 5/1994 | Japan | 211/191 |

*Primary Examiner*—Peter M. Cuomo
*Assistant Examiner*—Jerar A. Anderson
*Attorney, Agent, or Firm*—Koley Jessen P.C. A Limited Liability Organization; Mark D. Frederiksen

[57] ABSTRACT

A shelving system includes a pair of upright frames with a plurality of shelves connected therebetween, each upright frame including a pair of vertical posts with a plurality of braces extending between the posts to form rigid frames. Each post is generally U-shaped, with each brace having an end journaled within the U-shaped frame, and removably secured utilizing a plurality of protrusions engaged within apertures in a leg of each post. Each brace has a width which is effective to snugly secure the brace between the legs of each post. Each end of each brace has an upper and lower protrusion with a ramped distal portion for separating the legs of the post as the brace is inserted between the legs of the post. A proximal flat face on each protrusion engages a straight edge of each aperture to resist removal of the brace end from the post. The distance between the proximal flat face of each protrusion and the end of each brace is substantially the same as the distance between the web of each post and the flat distal edge of each protrusion, such that each brace end is securely engaged with the end of the brace in contact with the web of the posts and the protrusion proximal flat faces in engagement with the aperture edges. Vertical movement of each brace is resisted by use of a central protrusion on the ends of each brace located between the upper and lower protrusions, having flat upper and lower faces in engagement with straight edges of a central aperture on each post. In addition, vertical movement is resisted by the use of flat horizontal faces on the upper and lower protrusions which engage straight edges on the upper and lower apertures.

31 Claims, 11 Drawing Sheets

SHELVING SYSTEM BRACE AND POST

CROSS-REFERENCES TO RELATED APPLICATIONS (Not applicable)

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to shelving systems, and more particularly to an improved brace and post connection in a shelving assembly.

(2) Background Information

Prior art construction of shelving systems in warehouses and commercial establishments typically utilize nut and bolt fasteners to interconnect all of the components of the system. While such shelving systems were sufficient for their purpose, they required substantial time and effort to construct.

In an attempt to improve on prior art shelving construction, U.S. Pat. No. 5,735,221 to Benayon discloses a shelving construction which requires no tools or fasteners, to thereby reduce the time for assembly. While the Benayon patent is clearly an improvement over the prior art, there is still a need for improved ease and speed of the assembly, and a reduced cost to manufacture the various brace and post components.

BRIEF SUMMARY OF THE INVENTION

It is therefore a general object of the present invention to provide an improved brace and post assembly for a shelving system.

Another object is to provide an improved brace and post assembly which permits quick connection of a brace to a post, while maintaining a secure rigid connection, without requiring the use of tools.

The shelving system of the present invention includes a pair of upright frames with a plurality of shelves connected therebetween, each upright frame including a pair of vertical posts with a plurality of braces extending between the posts to form rigid frames. Each post is generally U-shaped, with each brace having an end journaled within the U-shaped frame, and removably secured utilizing a plurality of protrusions engaged within apertures in a leg of each post. Each brace has a width which is effective to snugly secure the brace between the legs of each post. Each end of each brace has an upper and lower protrusion with a ramped distal portion for separating the legs of the post as the brace is inserted between the legs of the post. A proximal flat face on each protrusion engages a straight edge of each aperture to resist removal of the brace end from the post. The distance between the proximal flat face of each protrusion and the end of each brace is substantially the same as the distance between the web of each post and the flat distal edge of each protrusion, such that each brace end is securely engaged with the end of the brace in contact with the web of the posts and the protrusion proximal flat faces in engagement with the aperture edges. Vertical movement of each brace is resisted by use of a central protrusion on the ends of each brace located between the upper and lower protrusions, having flat upper and lower faces in engagement with straight edges of a central aperture on each post. In addition, vertical movement is resisted by the use of flat horizontal faces on the upper and lower protrusions which engage straight edges on the upper and lower apertures.

BRIEF DESCRIPTION OF THE SEVERAL VIEWS OF THE DRAWING

Several embodiments of this invention are illustrated in the accompanying drawing, in which similar or corresponding parts are identified with the same reference numeral throughout the several views, and in which.

DETAILED DESCRIPTION OF THE INVENTION

Figure 1:
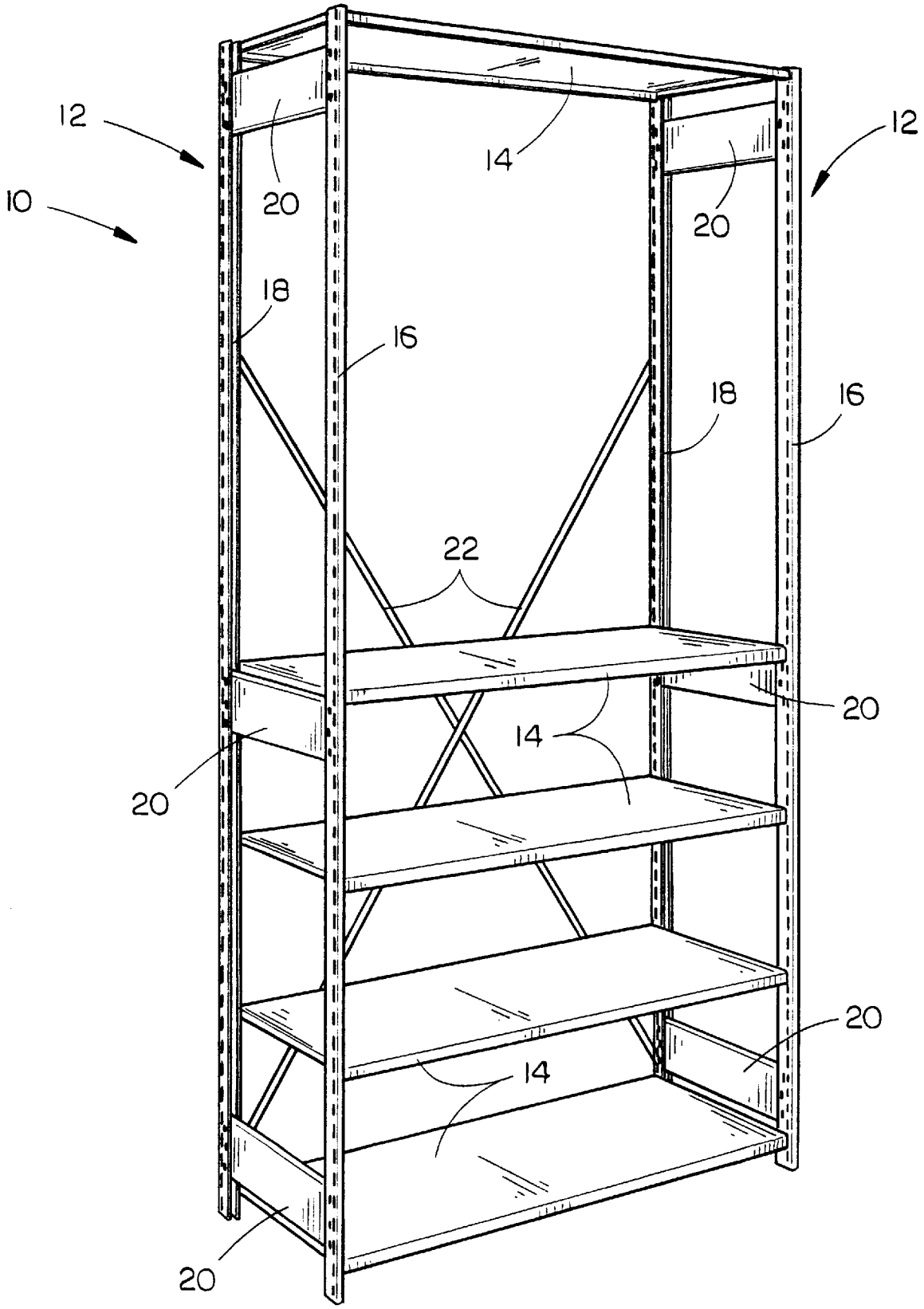
FIG. 1 is a perspective view of a complete shelving unit of the present invention.

Referring now to FIG. 1, the shelving system of the present invention is designated generally at 10 and includes a plurality of upright assemblies 12 with a plurality of shelves 14 extending between a pair of upright assemblies 12. Each upright assembly 12 includes a forward vertical post 16, a rearward vertical post 18 parallel to the forward post 16, and at least one horizontal brace 20 fastened between forward and rearward posts 16 and 18. Elongated cross-members 22 extend diagonally between pairs of rearward post 18, to provide structural integrity to the shelving system 10.

Figure 2:
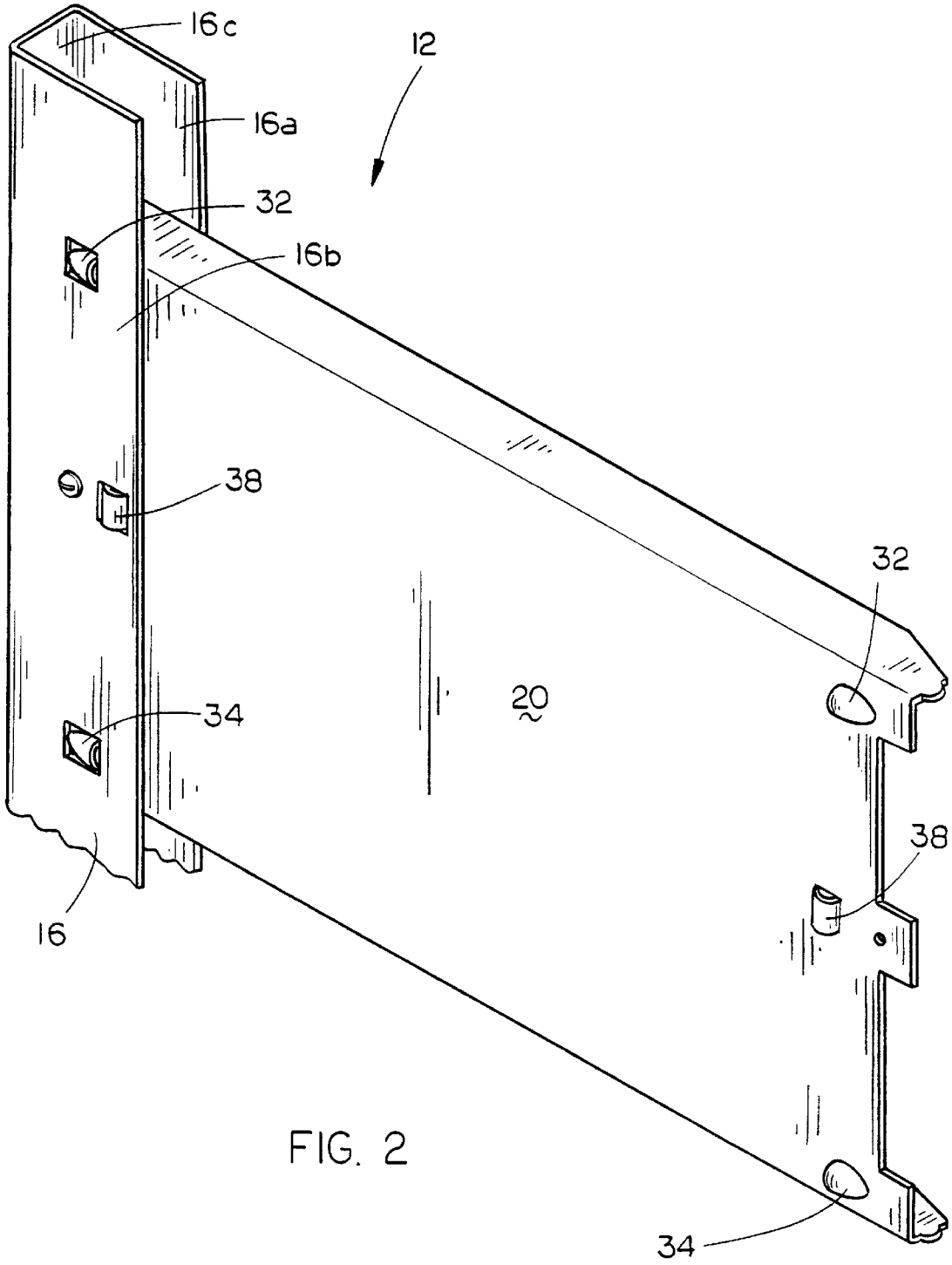
FIG. 2 is an enlarged perspective view showing the connection of one end of a brace with a post.
Figure 3:
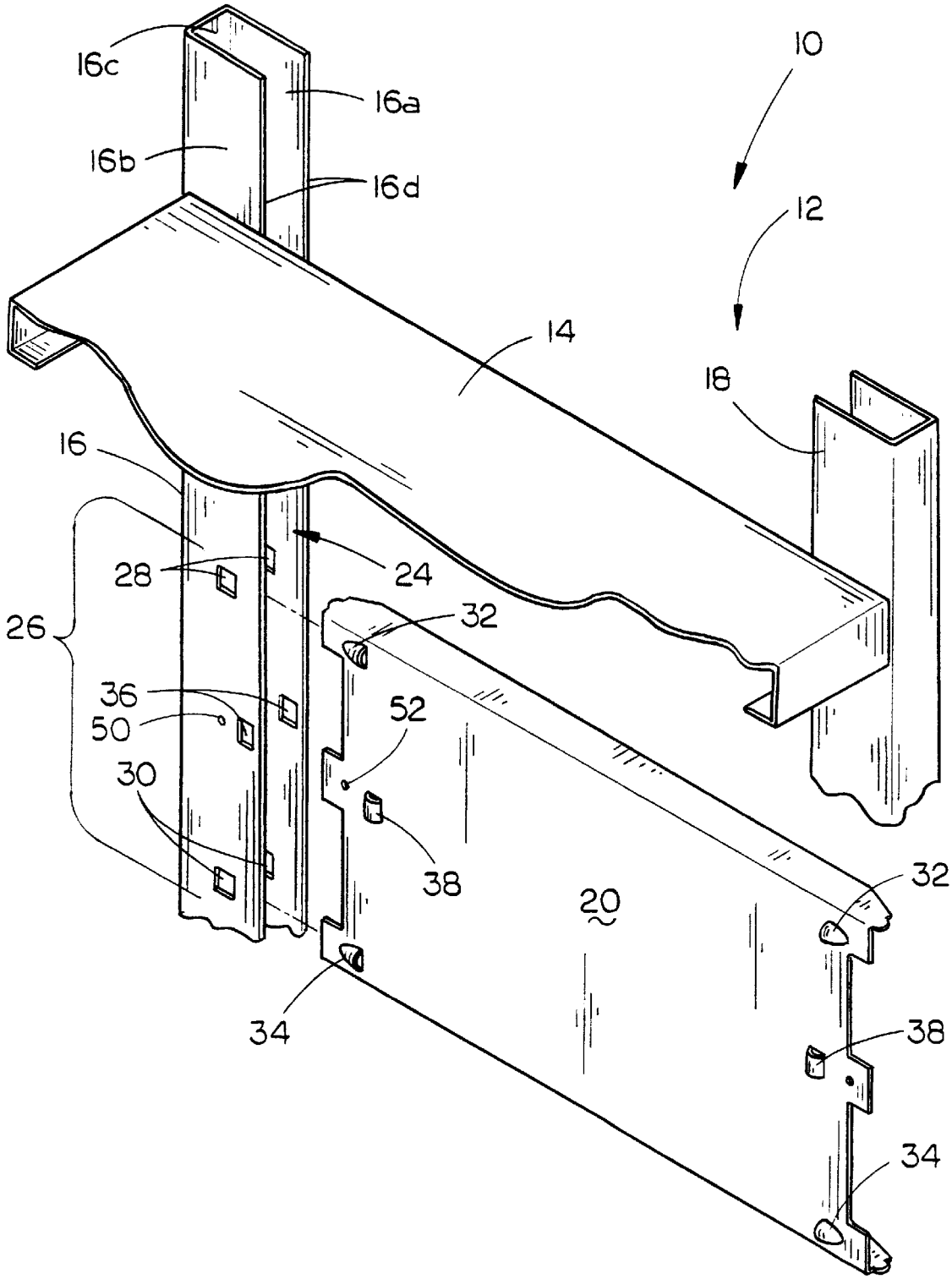
FIG. 3 is an enlarged perspective view showing a brace removed from its connection with a post.
Figure 5:
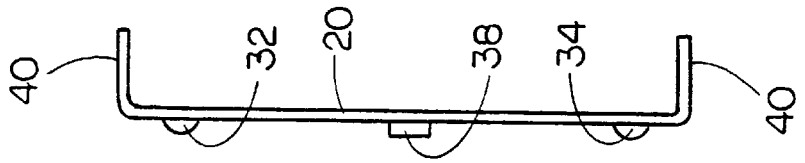
FIG. 5 is an end view of the brace of FIG. 4, after folding.

Referring now to FIGS. 2 and 3, posts 16 and 18 are U-shaped channels, and are preferably identical to one another. For this reason, only forward post 16 will be described in detail herein. Post 16 includes a pair of parallel legs 16*a* and 16*b* connected along one edge to a web 16*c*, the legs 16*a* and 16*b* forming a throat 24 into which one end of a brace 20 is inserted for securement to the post 16.

Each post leg 16*a* and 16*b* has a plurality of pairs of apertures 26 vertically aligned on each leg, and horizontally aligned between legs 16*a* and 16*b*. Each aperture pair 26 includes an upper aperture 28 and a lower aperture 30 shaped to receive a pair of upper and lower protrusions 32 and 34 formed on the end of brace 20, as described in more detail hereinbelow. A third aperture 36 is vertically centered between each pair of upper and lower apertures 28 and 30, and is preferably located horizontally closer to the free edge 16*d* of each leg 16*a* and 16*b*, than apertures 28 and 30. Each third aperture 36 is located to receive a third central protrusion 38 on one end of brace 20, as described in more detail hereinbelow.

Figure 4:
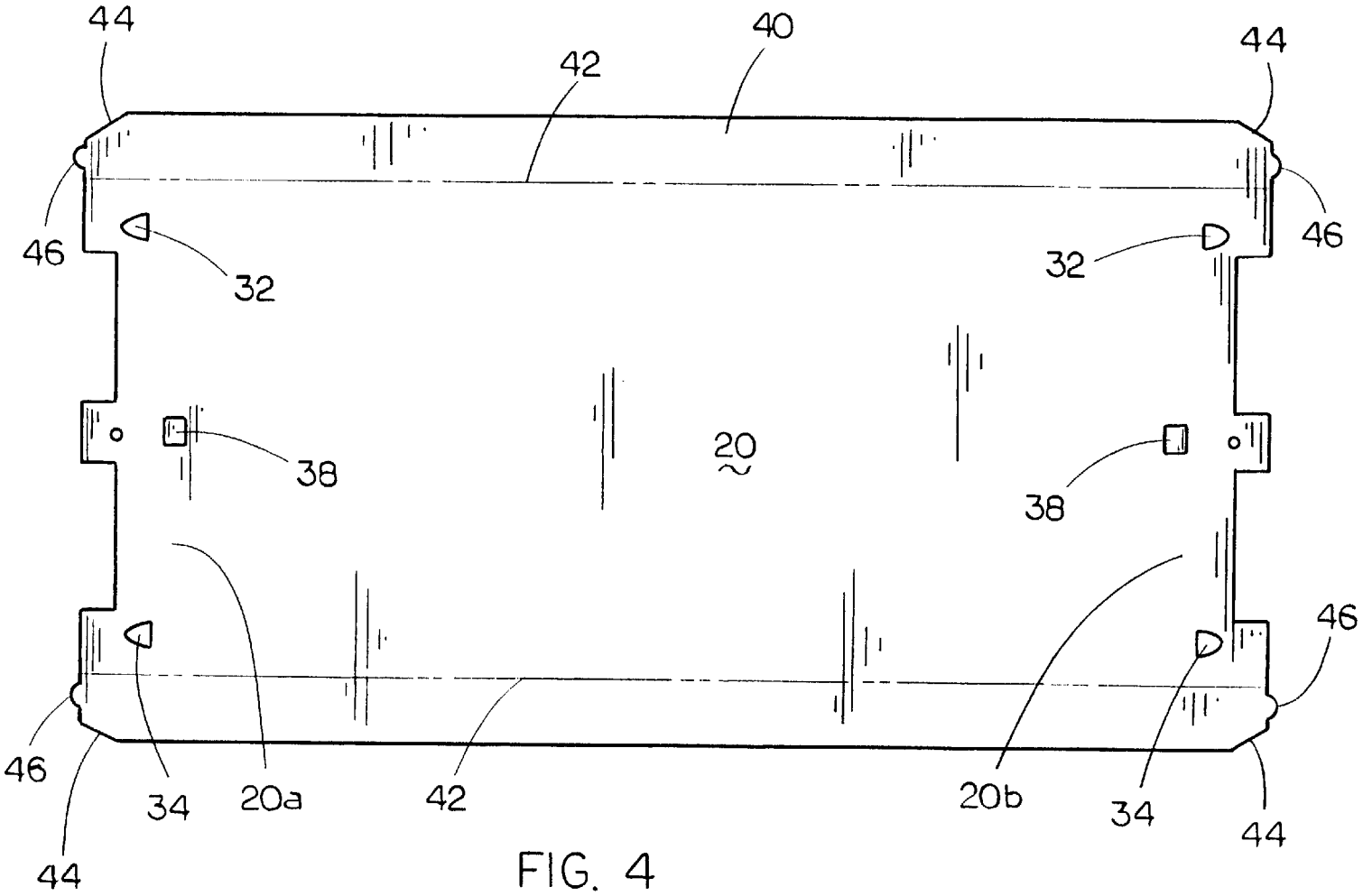
FIG. 4 is a plan view of a blank for the brace component of the shelving of the invention, after stamping but prior to folding.

Referring now to FIG. 4, each brace 20 is essentially a rectangular piece of material, with longitudinally extending flanges 40 folded at right angles along fold lines 42 to improve stiffness. Each end of flanges 40 has a bevel 44 to assist in the insertion of the ends 20*a* and 20*b* of brace 20 into the throat 24 of a post 16 or 18. Preferably, each marginal portion 40 has a width (measured from the free edge to fold line 42) to form a snug fit between the legs 16*a* and 16*b* of post 16.

Each brace 20 has opposing ends 20*a* and 20*b*, each end having an upper protrusion 32, a lower protrusion 34 and a central protrusion 38 projecting from the forward surface 20*c* thereof. Each of protrusions 32 and 34 have a sloped or ramped distal portion 32*a* and 34*a* respectively which will contact the free edge 16*d* of post leg 16*b* to thereby spread the legs of post 16 and allow insertion of end 20*a* of brace 20 into the throat 24. Vertical faces 32*b* and 34*b* on the proximal ends of protrusions 32 and 34 will engage the distal edge 28*a* and 30*a* of apertures 28 and 30 in post 16 to prevent movement along a longitudinal axis of brace 20 once protrusions 32 and 34 have engaged apertures 28 and 30.

Figure 6:
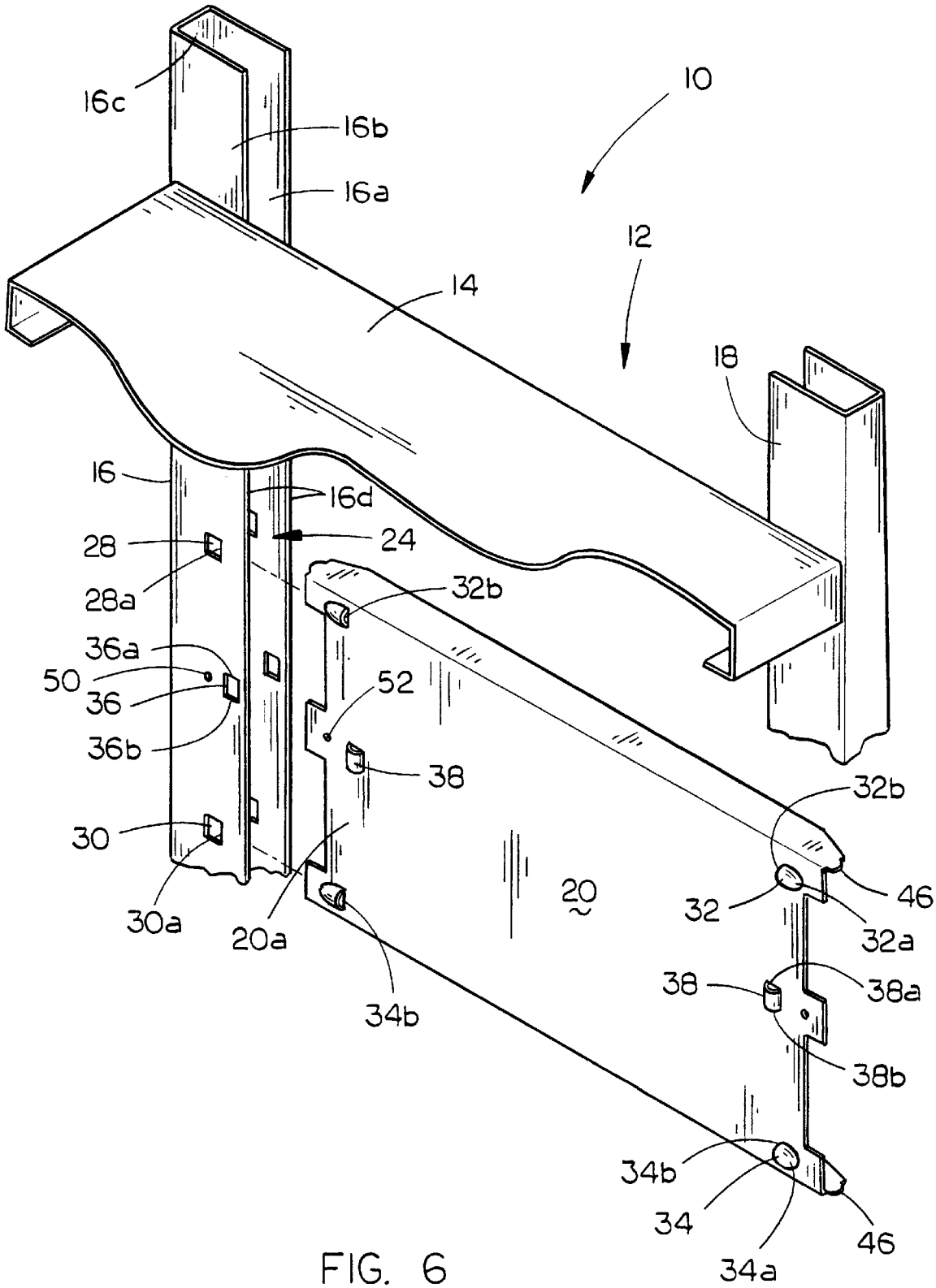
FIG. 6 is an enlarged exploded perspective view of one end of a brace and the associated portion of a post.

Horizontal faces 38*a* and 38*b* on the upper and lower ends of protrusion 38 will similarly engage the upper and lower edges 36*a* and 36*b* of aperture 36, to prevent movement of brace 20 along a vertical axis, once protrusion 38 has engaged aperture 36. The snug fit of flanges 40 between legs 16*a* and 16*b* of post 16 prevents movement of brace 20 along a transverse axis perpendicular to the longitudinal and vertical axes of brace 20. In addition, central protrusion 38 assists upper and lower protrusions 32 and 34 to discourage rotational movement of brace 20 within throat 24 of post 16. Vertical faces 32*b* and 34*b* of protrusions 32 and 34 are located a distance from the free end of brace 20 which is substantially equal to the distance between aperture edges 28*a* and 30*a* and the inward face of the web 16*c* of post 16. This also assists in preventing rotational movement of brace 20 within the throat 24 of post 16. Additional resistance to movement of brace 20 relative to post 16 may be imposed by the addition of a fastener (see FIG. 2) through clearance hole 50 in post 16 and pilot hole 52 in brace 20 (as shown in FIGS. 3 and 6). With the use of a fastener, it is not necessary that the free end of the brace contact the web 16*c* of post 16.

Figure 7:
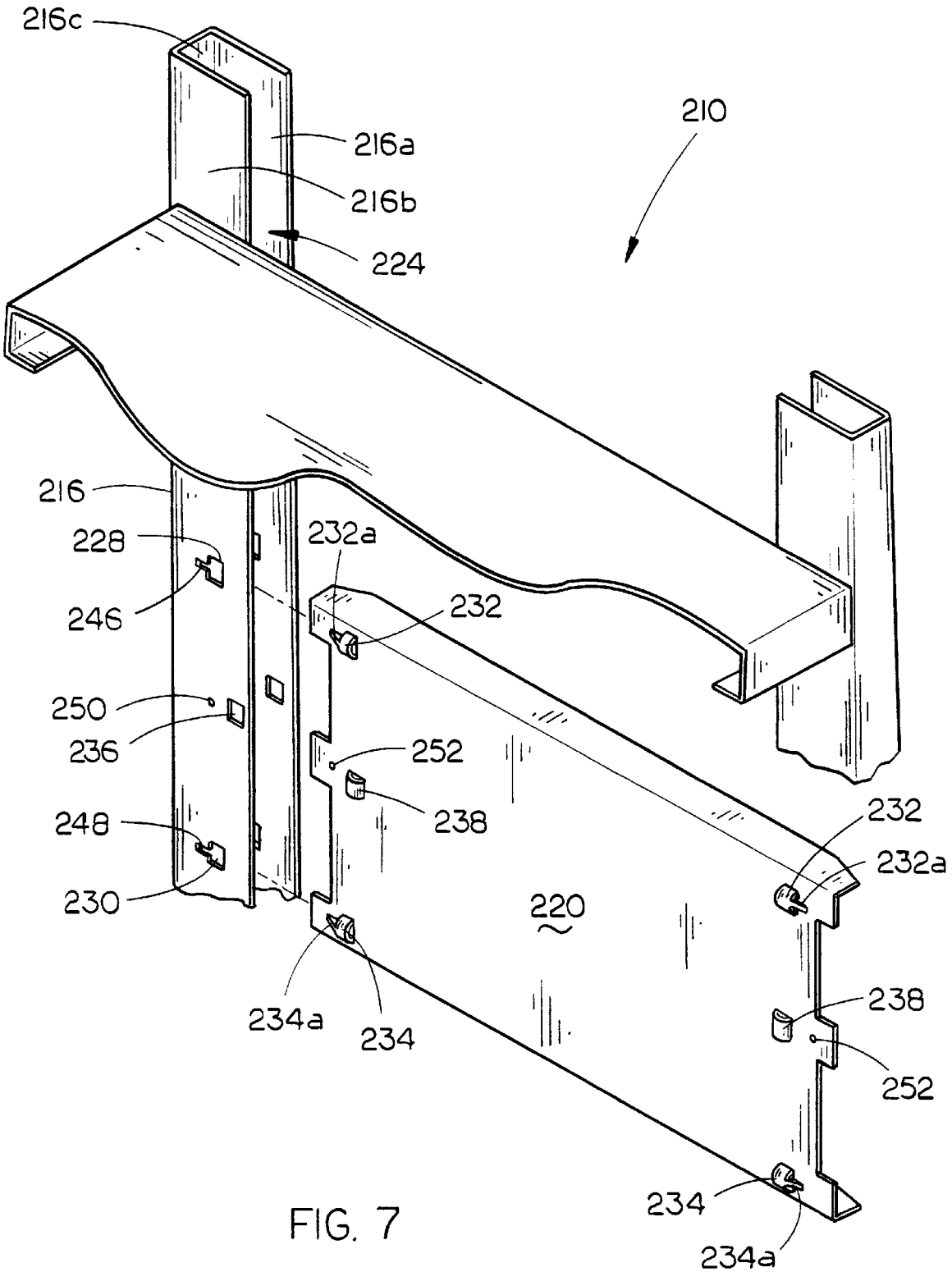
FIG. 7 is a perspective view similar to FIG. 6, but showing a second embodiment of the brace and post.

As shown in FIGS. 2–6, the sloped or ramped portions 32*a* and 34*a* of upper and lower protrusions 32 and 34 have a generally truncated spherical shape. However, many other sloped shapes will work equally as well. For example, FIG. 7 discloses a second embodiment of the invention, designated generally at 210, which includes the same brace 220 inserted within the throat 224 of a post 216, with upper and lower protrusions 232 and 234 designed for engagement with upper and lower apertures 228 and 230, and a central protrusion 238 designed to engage central aperture 236. Upper and lower protrusions 232 and 234 include a distally projecting ramped surface 232*a* and 234*a* respectively which serve to spread the legs 216*a* and 216*b* of post 216 upon insertion of brace 220 into throat 224. In the second embodiment of the invention, ramped surfaces 232*a* and 234*a* have a generally triangular flat plate with upper and lower horizontal surfaces which will engage the sides of a rectangular slot 246 and 248 respectively extending from post apertures 228 and 230 respectively. Additional resistance to movement of the brace 220 relative to post 216 may be imposed by the addition of a fastener through clearance hole 250 in post 216 and pilot hole 252 in brace 220.

Figures 8, 9:
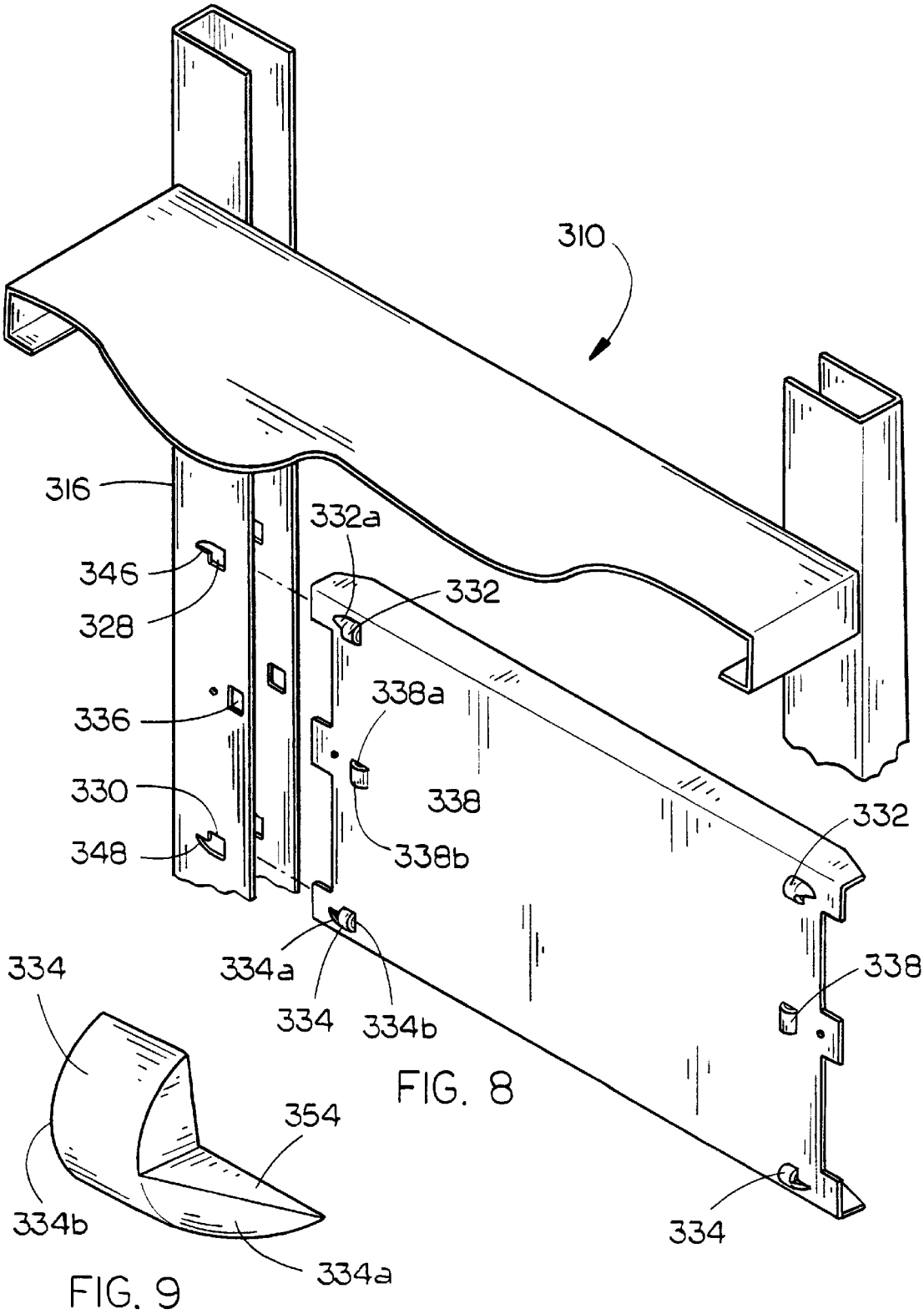
FIG. 8 is a perspective view similar to FIG. 6, but showing a third embodiment of the brace and post.
FIG. 9 is an enlarged perspective view of one protrusion of a brace.

A third embodiment of the invention is designated generally at 310 in FIG. 8, and also utilizes the same brace 320 installed on a post 316 as the first and second embodiments of the invention. In the third embodiment of the invention 310, upper and lower protrusions 332 and 334 have a ramped surface 332*a* and 334*a* which is generally in the shape of a quadrant of a sphere, as shown in FIGS. 8 and 9. Lower protrusion ramp 334*a* is formed with a flat horizontal upper surface 354, while upper protrusion ramped surface 332*a* has a flat lower horizontal surface 356 opposed to the upper surface 354 of the lower protrusion 334. Upper and lower apertures 328 and 330 include an augmented slot 346 and 348 respectively in the shape of a quarter circle and oriented to match and engage the ramped surfaces 332*a* and 334*a* respectively. In this way, it can be seen that the opposing lower and upper surfaces 356 and 354 of the upper and lower protrusions 332 and 334 prevent movement of brace 320 in a vertical direction relative to post 316, in addition to the horizontal surfaces 338*a* and 338*b* of central protrusion 338. In fact, central protrusion 338 would not be absolutely necessary, in view of the incorporation of surfaces 356 and 354 on protrusions 332 and 334.

Figure 10:
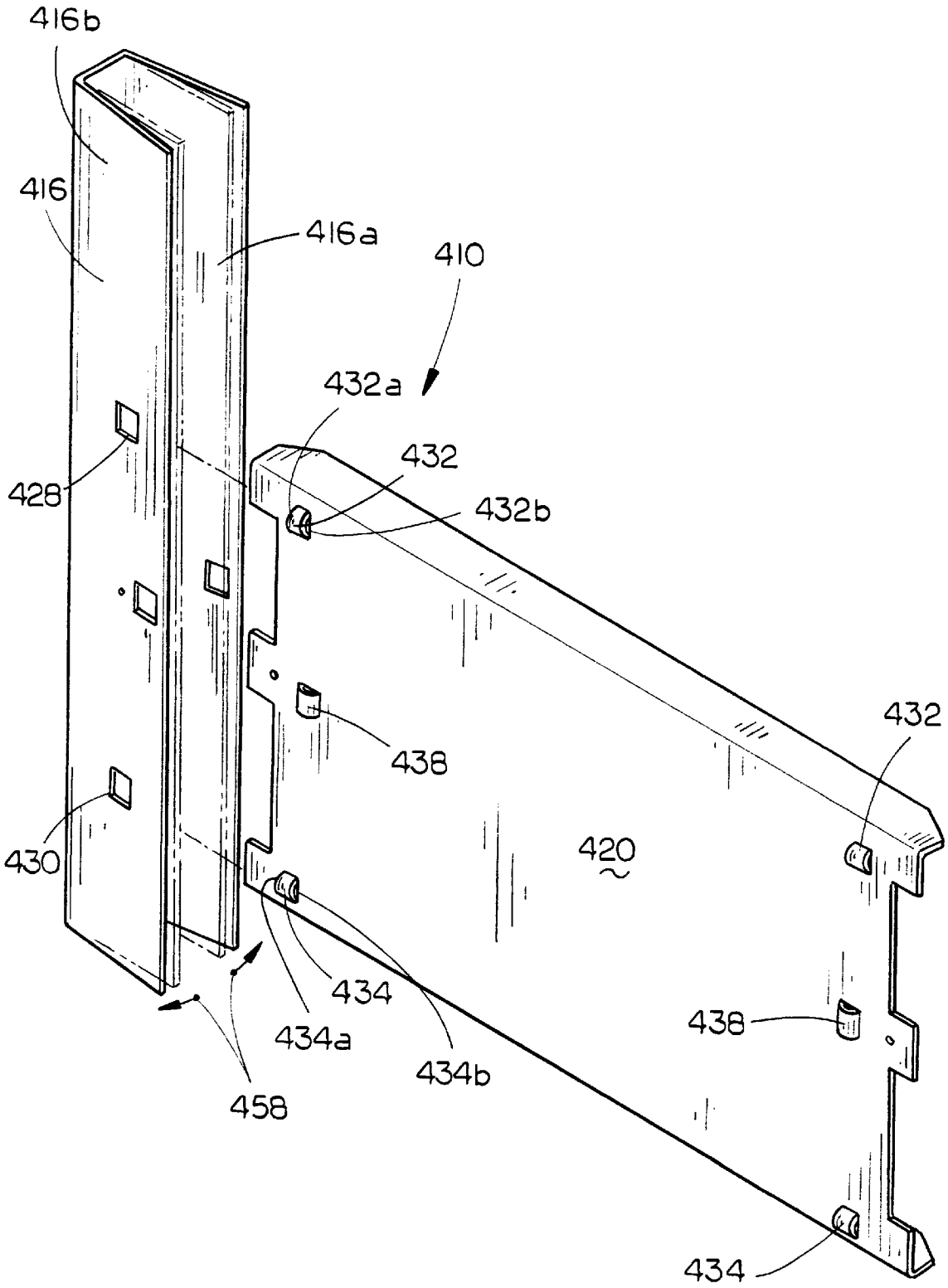
FIG. 10 is a perspective view similar to FIG. 3, but showing a fourth embodiment of the brace and post.
Figure 11:
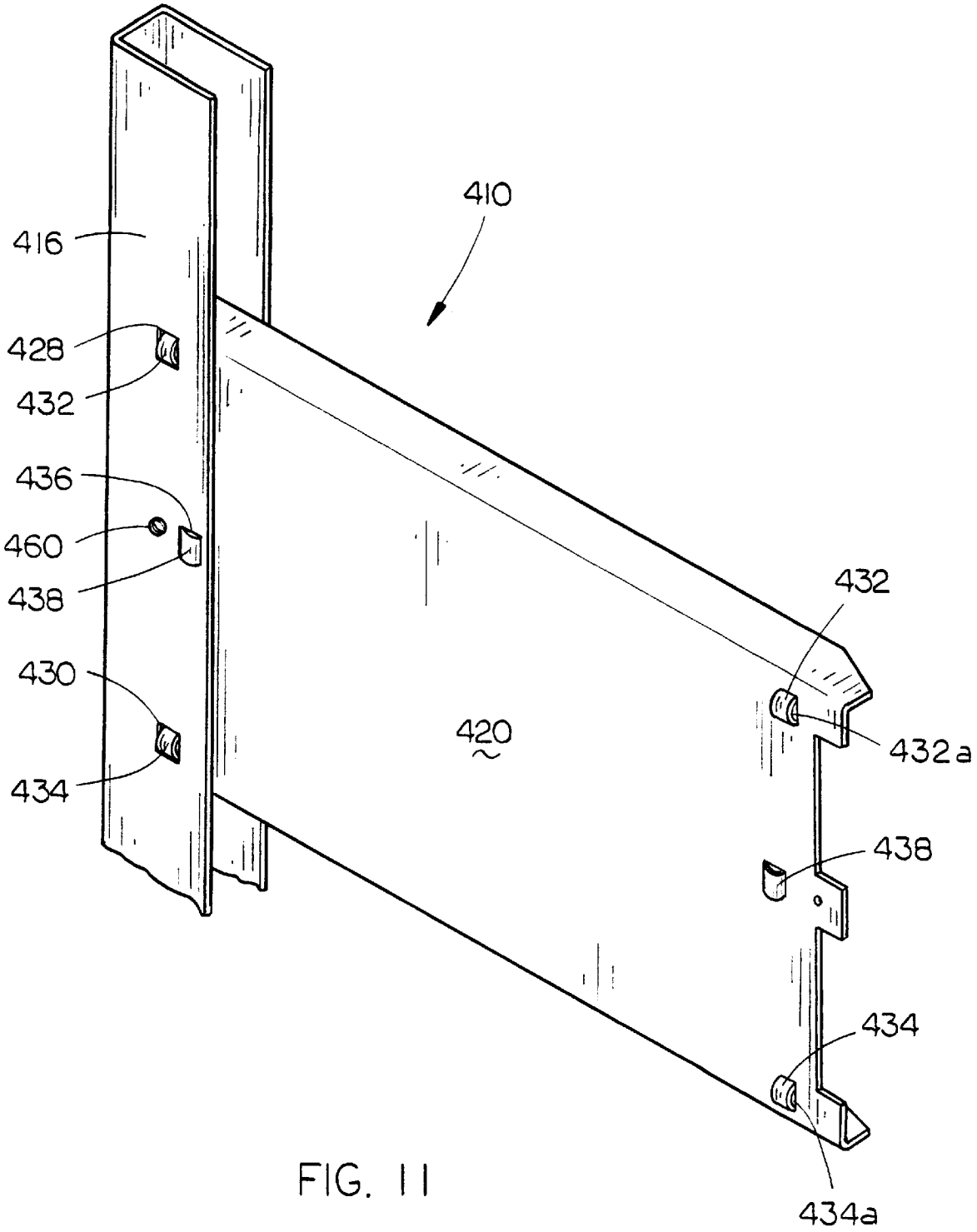
FIG. 11 is a perspective view similar to FIG. 2, showing the fourth embodiment of FIG. 10.

Referring now to FIGS. 10 and 11, a fourth embodiment of the invention is designated generally at 410, and utilizes the same brace 420 installed on a post 416 as the previous embodiments of the invention. In the fourth embodiment 410, upper and lower protrusions 432 and 434 have a flat vertical forward surface 432*a* and 434*a* which is parallel to the rearward vertical faces 432*b* and 434*b* respectively. Because the forward faces 432*a* and 434*a* are flat vertical surfaces, it is necessary to manually spread apart the legs 416*a* and 416*b* to permit insertion of the free end of brace 420 into the throat 424 of post 416, as shown by arrows 458.

Upper and lower apertures 428 and 430 are generally rectangular, so that the proximal and distal edges of each aperture are in abutting contact with the forward and rearward vertical faces of upper and lower protrusions 432 and 434, as shown in FIG. 11. Third aperture 436 and central aperture 438 are the same as those shown in the previous embodiments of the invention. A fastener 460 may be utilized to secure the brace 420 to post 416.

Figure 12:
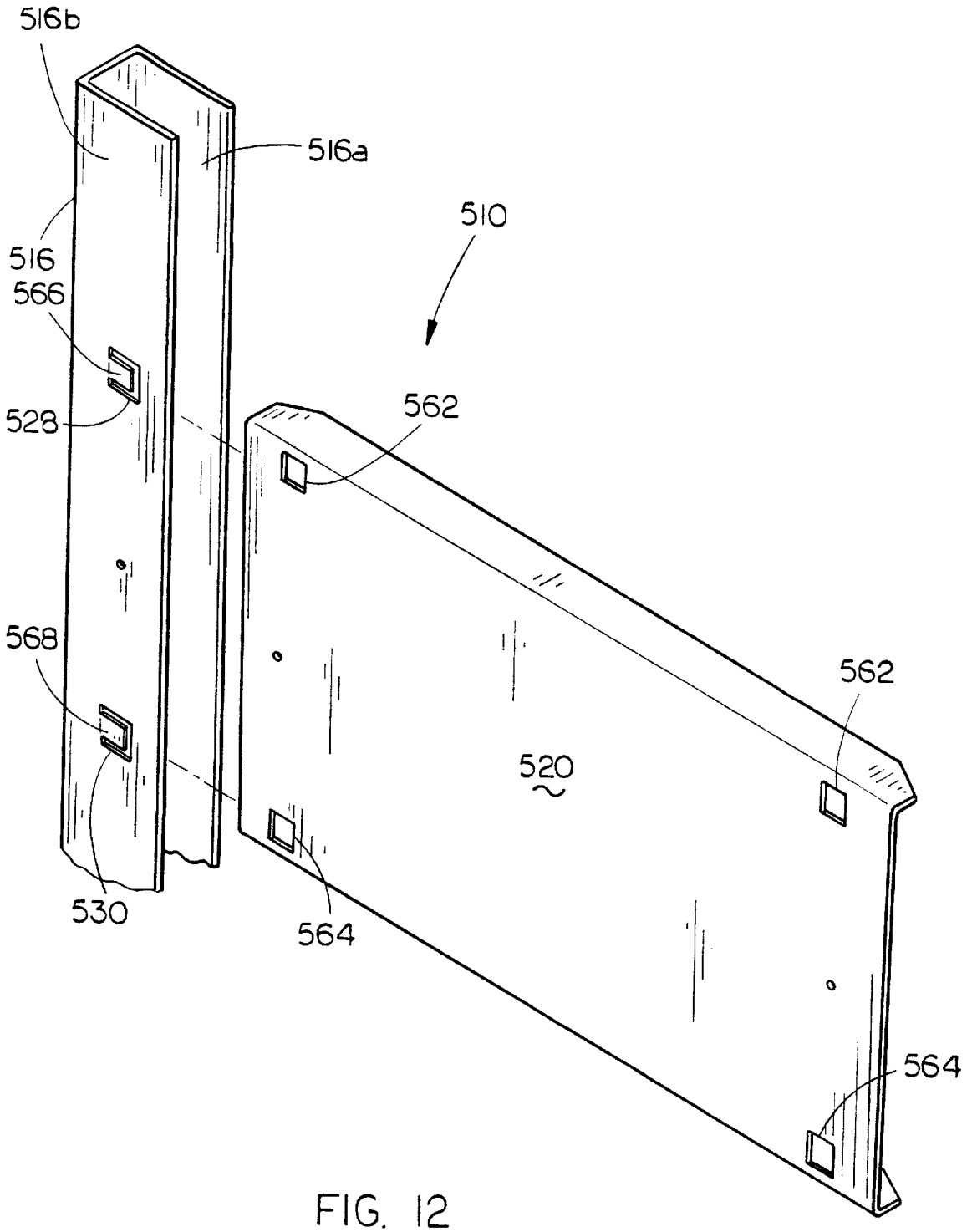
FIG. 12 is a perspective view similar to FIG. 10, but showing a fifth embodiment of the brace and post.
Figure 13:
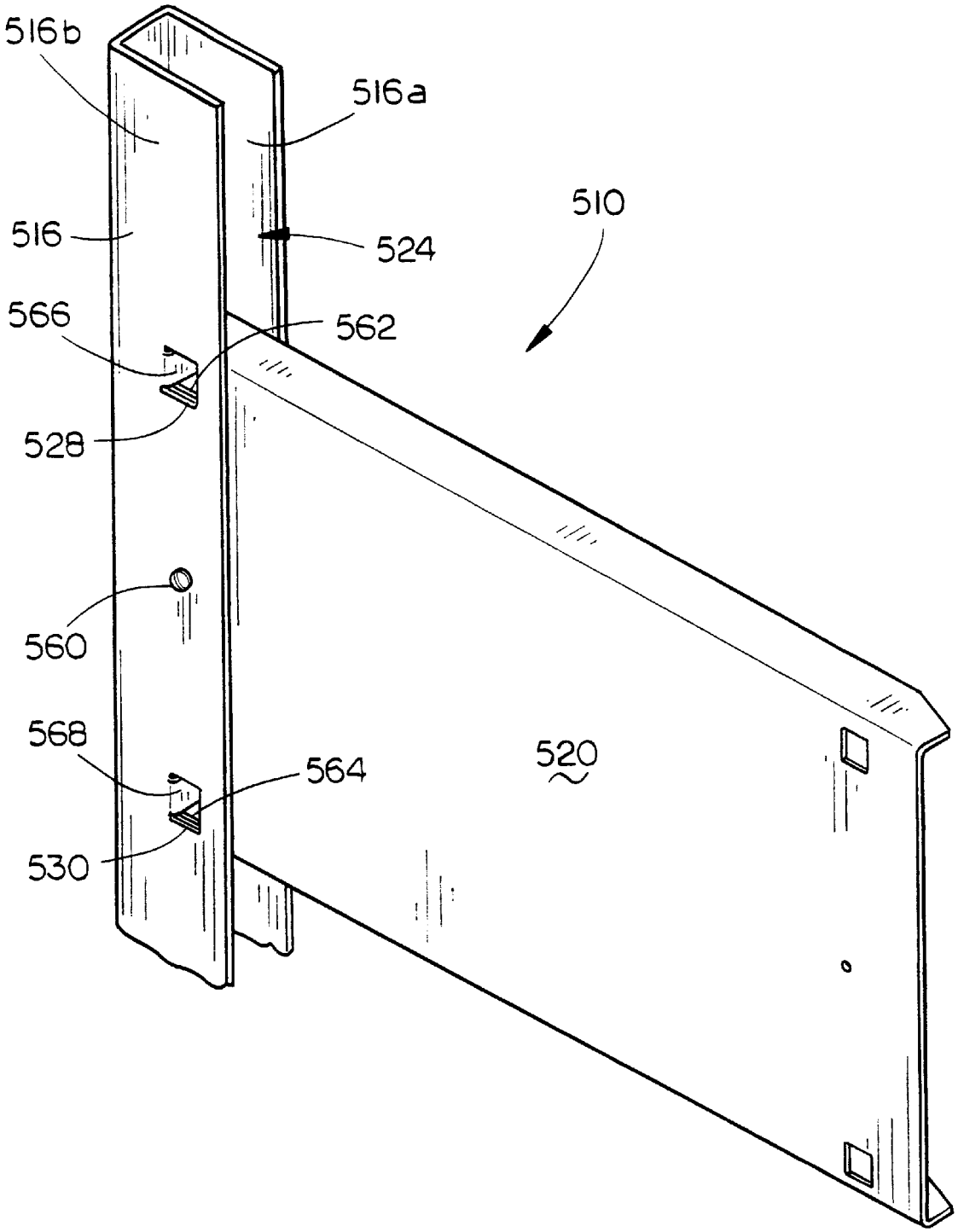
FIG. 13 is a view similar to FIG. 11, but showing the fifth embodiment of the invention.

A fifth embodiment of the invention is designated generally at 510 in FIGS. 12 and 13, and utilizes the same brace 520 installed on a post 516 as the previous embodiments of the invention. However, in the fifth embodiment of the invention, brace 520 omits protrusions, and utilizes upper and lower rectangular apertures 562 and 564, respectively, in place of the protrusions at each end of the brace. Upper and lower brace apertures 562 and 564 will align with upper and lower post apertures 528 and 530 when brace 520 is inserted between the legs 516*a* and 516*b* of post 516. Each post aperture 528 and 530 is augmented with a bendable tab 566 and 568 respectively, projecting coplanar with post leg 516*b* into the apertures 528 and 530. Once the free end of brace 520 is inserted within the throat 524 of post 516, each tab 566 and 568 is bent inwardly through the brace apertures 562 and 564, to prevent vertical and horizontal movement of brace 520. A fastener 560 may be utilized to further secure the brace within post 516.

Whereas the invention has been shown and described in connection with the preferred embodiments thereof, many modifications, substitutions and additions may be made which are within the intended broad scope of the appended claims.

We claim:

1. An upright frame for a shelving system, comprising:

a pair of parallel, vertically oriented posts, said posts having a pair of legs connected by a web to form a throat with a generally U-shaped cross-section;

the posts oriented with their throats directed towards one another;

a brace removably secured between the posts to form a generally rigid frame;

said brace having an effective width such that it is snugly received between the legs of each post within the throat;

each post having at least one pair of apertures formed in a leg at a location for receiving protrusions on an end of a brace;

said pair of apertures including an upper and lower aperture with a straight distal edge parallel to the web of the post;

said brace having an end removably secured between the legs of a post, each brace end having an upper and lower protrusion located on a forward face to engage the upper and lower apertures of said pair of post apertures;

each brace protrusion having a distal ramped portion for separating the legs of a post as the brace end is inserted within the throat, and a proximal flat face perpendicular to the forward face of the brace and located in abutting contact with each aperture distal edge; and said brace having a length from each end to each adjacent protrusion flat face which is substantially the same as a length measured between each post aperture distal edge and the post web, to thereby prevent movement of the brace along a first axis oriented parallel to a longitudinal axis of the brace, and prevent rotational movement of said brace relative to the post about a horizontal second axis orthogonal to the first axis.

2. The frame of claim 1, further comprising:

at least a second brace spaced vertically from the first brace and having an effective width such that it is snugly received between the legs of each post within the throat;

each post having at least a second pair of apertures formed in the same leg as the first pair of apertures and spaced vertically therefrom at a location for receiving protrusions on an end of a brace;

said second pair of apertures including an upper and lower aperture with a straight distal edge parallel to the web of the post;

said second brace having an end removably secured between the legs of a post, each second brace end having an upper and lower protrusion located on a forward face to engage the upper and lower apertures of said second pair of post apertures;

each said second brace protrusion having a distal ramped portion for separating the legs of a post as the brace is inserted within the throat, and a proximal flat face perpendicular to the forward face of the second brace and located in abutting contact with each aperture distal edge; and said second brace having a length from each end to each adjacent protrusion flat face which is substantially the same as a length measured between each post aperture distal edge and the post web, to thereby prevent movement of the brace along a first axis oriented parallel to a longitudinal axis of the brace, and prevent rotational movement of said brace relative to the post about a horizontal axis orthogonal to the first axis.

3. The frame of claim 2, further comprising means for restraining vertical movement of each brace relative to each post.

4. The frame of claim 3, wherein said means for resisting vertical movement of each brace includes:

an intermediate aperture located in a leg of each post between each pair of lower and upper apertures, for receiving a protrusion on an end of each brace;

each said intermediate aperture having parallel, straight, upper and lower edges;

a central protrusion formed on the forward face at each end of the brace between the upper and lower protrusions and located in engagement with one of said intermediate apertures on each post;

said central protrusion having upper and lower parallel, flat, horizontal faces located in abutting contact with the intermediate aperture upper and lower edges.

5. The frame of claim 3, wherein said means for resisting vertical movement of each brace includes:

each said upper aperture in the posts having a straight lower edge portion;

each upper protrusion having a lower flat horizontal face portion located in abutting contact with the upper aperture straight lower edge portion;

each lower aperture in the posts having a straight upper edge portion; and each lower protrusion having an upper flat horizontal face portion located in abutting contact with the lower aperture straight upper edge portion.

6. The frame of claim 4, wherein said means for resisting vertical movement of each brace includes:

each said upper aperture in the posts having a straight lower edge portion;

each upper protrusion having a lower flat horizontal face portion located in abutting contact with the upper aperture straight lower edge portion;

each lower aperture in the posts having a straight upper edge portion; and each lower protrusion having an upper flat horizontal face portion located in abutting contact with the lower aperture straight upper edge portion.

7. The frame of claim 6, wherein each upper protrusion lower face portion is formed on said ramped portion, and wherein each lower protrusion upper face portion is formed on said ramped portion.

8. The frame of claim 7, wherein each ramped portion is generally formed in the shape of one-eighth of a sphere.

9. The frame of claim 7, wherein each ramped portion is generally formed in the shape of a triangular plate with upper and lower parallel flat faces.

10. The frame of claim 8, wherein the central protrusion is generally semicylindrical in shape.

11. The frame of claim 9, wherein the central protrusion is generally semicylindrical in shape.

12. The frame of claim 5, wherein each upper protrusion lower face portion is formed on said ramped portion, and wherein each lower protrusion upper face portion is formed on said ramped portion.

13. An upright frame for a shelving system, comprising:

a pair of parallel, vertically oriented posts, said posts having a pair of legs connected by a web to form a throat with a generally U-shaped cross-section;

the posts oriented with their throats directed towards one another;

a brace removably secured between the posts to form a generally rigid frame;

said brace having an effective width such that it is snugly received between the legs of each post within the throat;

each post having at least one pair of apertures formed in a leg at a location for receiving protrusions on an end of a brace;

said pair of apertures including an upper and lower aperture with a straight distal edge parallel to the web of the post;

said brace having an end removably secured between the legs of a post, each brace end having an upper and lower protrusion located on the forward face to engage the upper and lower apertures of said pair of post apertures; and means for fastening each end of said brace to a leg of each post to prevent movement of the post along a first axis oriented parallel to a longitudinal axis of the brace, and prevent rotational movement of said brace relative to the post about a horizontal second axis orthogonal to the first axis.

14. The frame of claim 1, further comprising:

at least a second brace spaced vertically from the first brace and having an effective width such that it is snugly received between the legs of each post within the throat;

each post having at least a second pair of apertures formed in the same leg as the first pair of apertures and spaced vertically therefrom at a location for receiving protrusions on an end of a brace;

said second pair of apertures including an upper and lower aperture with a straight distal edge parallel to the web of the post;

said second brace having an end removably secured between the legs of a post, each second brace end having an upper and lower protrusion located on a forward face to engage the upper and lower apertures of said second pair of post apertures;

each said second brace protrusion having a distal ramped portion for separating the legs of a post as the brace is inserted within the throat, and a proximal flat face perpendicular to the forward face of the second brace and located in abutting contact with each aperture distal edge; and means for fastening each end of said brace to a leg of each post to prevent movement of the post along a first axis oriented parallel to a longitudinal axis of the brace, and prevent rotational movement of said brace relative to the post about a horizontal second axis orthogonal to the first axis.

15. The frame of claim 14, further comprising means for restraining vertical movement of each brace relative to each post.

16. The frame of claim 15, wherein said means for resisting vertical movement of each brace includes:

each said upper aperture in the posts having a straight lower edge portion;

each upper protrusion having a lower flat horizontal face portion located in abutting contact with the upper aperture straight lower edge portion;

each lower aperture in the posts having a straight upper edge portion; and each lower protrusion having an upper flat horizontal face portion located in abutting contact with the lower aperture straight upper edge portion.

17. The frame of claim 16, wherein each upper protrusion lower face portion is formed on said ramped portion, and wherein each lower protrusion upper face portion is formed on said ramped portion.

18. The frame of claim 17, wherein each ramped portion is generally formed in the shape of one-eighth of a sphere.

19. A shelving system, comprising:

a pair of upright frames with a plurality of shelves connected therebetween;

each upright frame including:

a pair of parallel, vertically oriented posts, said posts having a pair of legs connected by a web to form a throat with a generally U-shaped cross-section;

the posts oriented with their throats directed towards one another;

a brace removably secured between the posts to form a generally rigid frame;

said brace having an effective width such that it is snugly received between the legs of each post within the throat;

each post having at least one pair of apertures formed in a leg at locations for receiving protrusions on an end of a brace;

said pair of apertures including an upper and lower aperture with a straight distal edge parallel to the web of the post;

said brace having an end removably secured between the legs of a post, each brace end having an upper and lower protrusion located on a forward face to engage the upper and lower apertures of said pair of post apertures;

each brace protrusion having a distal ramped portion for separating the legs of a post as the brace end is inserted within the throat, and a proximal flat face perpendicular to the forward face of the brace and located in abutting contact with each aperture distal end; and said brace having a length from each end to each adjacent protrusion flat face which is substantially the same as a length measured between each post aperture distal edge and the post web, to thereby prevent movement of the brace along a first axis oriented parallel to a longitudinal axis of the brace, and prevent rotational movement of said brace relative to the post about a horizontal second axis orthogonal to the first axis.

20. The frame of claim 19, further comprising:

at least a second brace spaced vertically from the first brace and having an effective width such that it is snugly received between the legs of each post within the throat;

each post having at least a second pair of apertures formed in the same leg as the first pair of apertures and spaced vertically therefrom at a location for receiving protrusions on an end of a brace;

said second pair of apertures including an upper and lower aperture with a straight distal edge parallel to the web of the post;

said second brace having an end removably secured between the legs of a post, each second brace end having an upper and lower protrusion located on a forward face to engage the upper and lower apertures of said second pair of post apertures;

each said second brace protrusion having a distal ramped portion for separating the legs of a post as the brace is inserted within the throat, and a proximal flat face perpendicular to the forward face of the second brace and located in abutting contact with each aperture distal edge; and means for fastening each end of said brace to a leg of each post to prevent movement of the post along a first axis oriented parallel to a longitudinal axis of the brace, and prevent rotational movement of said brace relative to the post about a horizontal second axis orthogonal to the first axis.

21. The shelving system of claim 20, further comprising means for resisting vertical movement of each brace relative to each post.

22. The shelving system of claim 21, wherein said means for resisting vertical movement of each brace includes:

an intermediate aperture located in a leg of each post between each pair of lower and upper apertures, for receiving a protrusion on an end of each brace;

each said intermediate aperture having parallel, straight, upper and lower edges;

a central protrusion formed on the forward face at each end of the brace between the upper and lower protrusions and located in engagement with one of said intermediate apertures on each post;

said central protrusion having upper and lower parallel, flat, horizontal faces located in abutting contact with the intermediate aperture upper and lower edges.

23. The shelving system of claim 21, wherein said means for resisting vertical movement of each brace includes:

each said upper aperture in the posts having a straight lower edge portion;

each upper protrusion having a lower flat horizontal face portion located in abutting contact with the upper aperture straight lower edge portion;

each lower aperture in the posts having a straight upper edge portion; and each lower protrusion having an upper flat horizontal face portion located in abutting contact with the lower aperture straight upper edge portion.

24. The frame of claim 23, wherein each upper protrusion lower face portion is formed on said ramped portion, and wherein each lower protrusion upper face portion is formed on said ramped portion.

25. A shelving system comprising:

a pair of upright frames with a plurality of shelves connected therebetween;

each upright frame including:

a pair of parallel, vertically oriented posts, said posts having a pair of legs connected by a web to form a throat with a generally U-shaped cross-section;

the posts oriented with their throats directed towards one another;

a brace removably secured between the posts to form a generally rigid frame;

said brace having an effective width such that it is snugly received between the legs of each post within the throat;

each post having at least one pair of apertures formed in a leg at a location for receiving protrusions on an end of a brace;

said pair of apertures including an upper and lower aperture with a straight distal edge parallel to the web of the post;

said brace having an end removably secured between the legs of a post, each brace end having an upper and lower protrusion located on the forward face to engage the upper and lower apertures of said pair of post apertures; and means for fastening each end of said brace to a leg of each post to prevent movement of the post along a first axis oriented parallel to a longitudinal axis of the brace, and prevent rotational movement of said brace relative to the post about a horizontal second axis orthogonal to the first axis.

26. The frame of claim 25, further comprising:

at least a second brace spaced vertically from the first brace and having an effective width such that it is snugly received between the legs of each post within the throat;

each post having at least a second pair of apertures formed in the same leg as the first pair of apertures and spaced vertically therefrom at a location for receiving protrusions on an end of a brace;

said second pair of apertures including an upper and lower aperture with a straight distal edge parallel to the web of the post;

said second brace having an end removably secured between the legs of a post, each second brace end having an upper and lower protrusion located on a forward face to engage the upper and lower apertures of said second pair of post apertures;

each said second brace protrusion having a distal ramped portion for separating the legs of a post as the brace is inserted within the throat, and a proximal flat face perpendicular to the forward face of the second brace and located in abutting contact with each aperture distal edge; and means for fastening each end of said brace to a leg of each post to prevent movement of the post along a first axis oriented parallel to a longitudinal axis of the brace, and prevent rotational movement of said brace relative to the post about a horizontal second axis orthogonal to the first axis.

27. The shelving system of claim 26, further comprising means for resisting vertical movement of each brace relative to each post.

28. The shelving system of claim 27, wherein said means for resisting vertical movement of each brace includes:

each said upper aperture in the posts having a straight lower edge portion;

each upper protrusion having a lower flat horizontal face portion located in abutting contact with the upper aperture straight lower edge portion;

each lower aperture in the posts having a straight upper edge portion; and each lower protrusion having an upper flat horizontal face portion located in abutting contact with the lower aperture straight upper edge portion.

29. The frame of claim 28, wherein each upper protrusion lower face portion is formed on said ramped portion, and wherein each lower protrusion upper face portion is formed on said ramped portion.

30. An upright frame for a shelving system, comprising:

a pair of parallel, vertically oriented posts, said posts having a pair of legs connected by a web to form a throat with a generally U-shaped cross-section;

the posts oriented with their throats directed towards one another;

a brace removably secured between the posts to form a generally rigid frame;

said brace having an effective width such that it is snugly received between the legs of each post within the throat;

each post having at least one pair of apertures formed in a leg at a location for receiving protrusions on an end of a brace;

said pair of apertures including an upper and lower aperture with parallel straight proximal and distal edges which are parallel to the web of the posts;

said brace having an end removably secured between the legs of a post, each brace end having an upper and lower protrusion located on a forward face to engage the upper and lower apertures of said pair of post apertures;

each brace protrusion having parallel distal and proximal flat faces perpendicular to the forward face of the brace end located in abutting contact with each aperture distal end proximal edge; and means interconnecting the ends of the brace and the post to prevent movement of the brace along a first axis oriented parallel to a longitudinal axis of the brace, and to prevent rotational movement of said brace relative to the post about a horizontal second axis orthogonal to the first axis.

31. An upright frame for a shelving system, comprising:

a pair of parallel, vertically oriented posts, said posts having a pair of legs connected by a web to form a throat with a generally U-shaped cross-section;

the posts oriented with their throats directed towards one another;

a brace removably secured between the posts to form a generally rigid frame;

said brace having an effective width such that it is snugly received between the legs of each post within the throat;

said brace having an end secured between the legs of each post, each brace end having an upper and lower aperture formed therein located adjacent a leg of each post;

said post having at least one pair of tabs formed in a leg and bent inwardly and journaled through said brace apertures; and means interconnecting the ends of the brace and the post to prevent movement of the brace along a first axis oriented parallel to a longitudinal axis of the brace, and prevent rotational movement of said brace relative to the posts about a horizontal second axis orthogonal to the first axis.

* * * * *